United States Patent [19]

Ishida

[11] 4,204,514

[45] May 27, 1980

[54] SPLIT OPERATION TYPE MULTI-CYLINDER INTERNAL COMBUSTION ENGINE

[75] Inventor: Yasuhiko Ishida, Mishima, Japan

[73] Assignee: Toyota Jidosha Kogyo Kabushiki Kaisha, Toyota, Japan

[21] Appl. No.: 964,823

[22] Filed: Nov. 30, 1978

[30] Foreign Application Priority Data

Dec. 19, 1977 [JP] Japan ..... 52-151634

[51] Int. Cl.[2] ..... F02D 17/00

[52] U.S. Cl. ..... 123/198 F; 123/32 EA; 123/124 R; 261/23 A; 261/47

[58] Field of Search ..... 123/198 F, 32 EA, 32 EH, 123/32 EL, 124 R; 261/23 A, 47

[56] References Cited

U.S. PATENT DOCUMENTS

| | | | |
|---|---|---|---|
| 2,085,818 | 7/1937 | Messinger | 123/198 F |
| 2,114,655 | 4/1938 | Leibing | 123/198 F |
| 2,954,022 | 9/1960 | Mich | 123/198 F |
| 4,073,278 | 2/1978 | Glenn | 261/23 A |
| 4,080,947 | 3/1978 | Tizuka | 123/124 R |
| 4,106,471 | 8/1978 | Nakajima et al. | 123/198 F |
| 4,107,921 | 8/1978 | Tizuka | 123/198 F |
| 4,109,634 | 8/1978 | Garabedian | 123/198 F |
| 4,130,102 | 12/1978 | Churchhill | 123/198 F |

*Primary Examiner*—Ira S. Lazarus

*Attorney, Agent, or Firm*—Kenyon & Kenyon

[57] ABSTRACT

An internal combustion engine having a plurality of cylinders which is divided into a first cylinder group and a second cylinder group. The engine comprises first and second air control means for controlling an amount of intake air fed into the first and second cylinder groups, respectively, and first and second fuel supply means for supplying the first and second cylinder groups with fuel. The second air control means allows inflow of air into the second cylinder group when the level of the load of the engine is lower than a predetermined level. The second fuel supply means supplies an amount of fuel in accordance with the amount of intake air passing through a second intake passage of the second cylinder group when the level of the load of the engine is higher than the predetermined level, and stops the fuel supplying operation when the level of the load of the engine is lower than the predetermined level. The engine further comprises an actuating means for increasing an amount of intake air passing through the first air control means in accordance with an increase in the level of the load of the engine, and for increasing an amount of intake air passing through the second air control means in accordance with an increase in the level of the load of the engine when the level of the load of the engine exceeds the predetermined level. The increasing speed of the amount of intake air passing through the second air control means is controlled higher than the increasing speed of the amount of intake air passing through the first air control means.

16 Claims, 7 Drawing Figures

SPLIT OPERATION TYPE MULTI-CYLINDER INTERNAL COMBUSTION ENGINE

DESCRIPTION OF THE INVENTION

The present invention relates to a split operation type multi-cylinder internal combustion engine having a number of cylinders divided into a plurality of groups, in which the respective cylinder groups are separately controlled according to the level of a load of the engine.

In multi-cylinder internal combustion engines used as engines for automobiles, control of the amount of air introduced into all of the cylinders is collectively performed by a single throttle valve disposed in an intake passage of the engine. In some cases, a plurality of throttle valves is used for respective cylinders or respective groups of cylinders. However, in this case, these throttle valves are connected so that the opening degree thereof is always the same for all of the throttle valves. Therefore, in an internal combustion engine equipped with such throttle valves, the amount of intake air sucked into each of the cylinders, namely, the level of the load of each cylinder is the same.

Generally, an autombile engine is kept in the ordinary operating condition during a substantial part of the driving period. The level of a load of the engine required during this ordinary operating condition is much lower than the maximum load level. Therefore, in an engine of this type, the value corresponding to the opening degree of the throttle valve is usually kept relatively small.

During the light load condition where the opening degree of the throttle valve is small and the amount of air introduced into the engine is small, since a great loss of work (pumping loss) is caused at the time of the intake stroke, the specific fuel consumption is increased. On the other hand, this specific fuel consumption is gradually reduced as the load of the engine is increased, in other words, as the opening degree of the throttle valve is increased. For the above-mentioned reason, conventional automobile engines cannot prevent the increase of the specific fuel consumption.

In order to eliminate the above-mentioned problem, various proposals have been made on the split operation type engine in which only some cylinders are actuated under a light load.

An object of the present invention is to further improve the internal combustion engines of the split operation type internal combustion engine having a simple structure in which the pumping loss can be further reduced and, hence, the specific fuel consumption can be remarkably decreased.

According to the present invention, there is provided an internal combustion engine having a plurality of cylinders which are divided into a first cylinder group and a second cylinder group, the first cylinder group having a first intake passage, the second cylinder group having a second intake passage. The engine comprises: a first air control means arranged in the first intake passage for controlling an amount of intake air fed into the first cylinder group; a first fuel supply means for supplying the first cylinder group with an amount of fuel in accordance with the amount of intake air passing through the first intake passage; a second air control means for controlling an amount of intake air fed into the second cylinder group, the second air control means allowing an inflow of air into the second cylinder group when the level of a load of the engine is lower than a predetermined level; a second fuel supply means for supplying the second cylinder group with an amount of fuel in accordance with the amount of intake air passing through the second intake passage, the above-mentioned fuel supplying operation being carried out when the level of the load of the engine is higher than the predetermined level, the second fuel supply means stopping the above-mentioned fuel supplying operation into the second cylinder group when the level of the load of the engine is lower than the predetermined level; and, an actuating means for increasing an amount of intake air passing through the first air control means in accordance with an increase in the level of the load of the engine, and for increasing an amount of intake air passing through the second air control means in accordance with an increase in the level of the load of the engine when the level of the load of the engine exceeds the predetermined level, the increasing speed of the amount of intake air passing through the second air control means being controlled higher than the increasing speed of the amount of intake air passing through the first air control means.

The above-mentioned and other related objects and features of the present invention will be apparent from the following description of the present invention with reference to the accompanying drawings, as well as from the appended claims.

DESCRIPTION OF PREFERRED EMBODIMENTS

Figure 1:
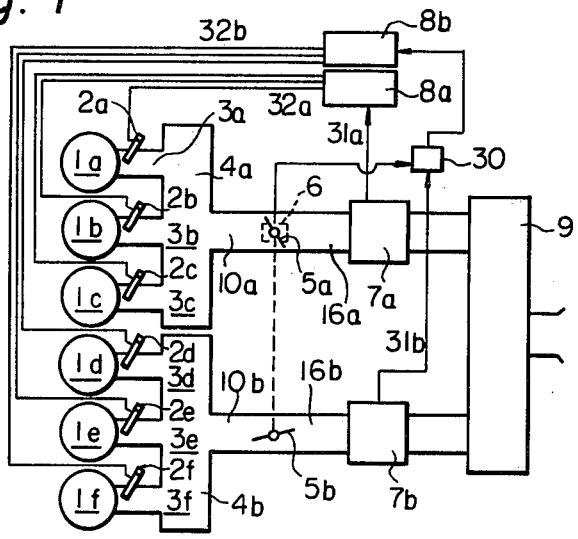
FIG. 1 is a schematic view of an embodiment of an engine according to the present invention.

FIG. 1 shows a schematic view of an embodiment of an internal combustion engine according to the present invention. Referring to FIG. 1, reference numerals 1*a*, 1*b*, 1*c*, 1*d*, 1*e*, 1*f* each represents a cylinder, 3*a*, 3*b*, 3*c*, 3*d*, 3*e*, 3*f* intake ports of cylinders 1*a*, 1*b*, 1*c*, 1*d*, 1*e*, 1*f*, respectively, and 2*a*, 2*b*, 2*c*, 2*d*, 2*e*, 2*f* fuel injection valves mounted on intake ports 3*a*, 3*b*, 3*c*, 3*d*,3*e*, 3*f*, respectively. The cylinders 1*a*, 1*b*, 1*c* constitute a first cylinder group, and the cylinders 1*d*, 1*e*, 1*f* constitute a second cylinder group. The first and second cylinder groups are provided with first and second intake passages 16*a* and 16*b* having surge tanks 4*a* and 4*b*, throttle valves 5*a* and 5*b*, and air flow meters 7*a* and 7*b* arranged in the intake passages 16*a* and 16*b* upstream of the throttle valves 5*a* and 5*b*, respectively. A common air cleaner is provided for the intake passages 16*a* and 16*b*. Electrical computers 8*a* and 8*b* are provided for the first and second cylinder groups, respectively. Electronic fuel injection control device comprising, as the main members, the computers 8*a* and 8*b*, the air flow meters 7*a* and 7*b*, and the fuel injection valves 2*a* through 2*f* are well known in the art of the present invention. In this embodiment, such electronic fuel injection control device is employed for each of the first and second cylinder groups. A fuel such as gasoline is fed under pressure to the fuel injection valves 2*a* through 2*f* from a fuel supply device (not shown). Fuel injection valves 2*a* through 2*f* are opened only when signals are applied from the computers 8*a* and 8*b*. In this case, the computers 8*a* and 8*b* calculate the amount of fuel to be injected into the respective cylinder groups in accordance with the level of air flow signals fed from the respective air flow meters 7*a* and 7*b*, which level corresponds to the amount of air sucked into the engine. Then, the computers 8*a* and 8*b* supply the fuel injection valves 2*a* through 2*f* with driving signals having durations corresponding to the calculated amount of fuel to be injected into the engine, via lines 31*a* and 31*b*, respectively.

A throttle position switch 6 for detecting that the opening degree of the throttle valve 5*a* arranged in the intake passage 16*a* exceeds a predetermined value is connected to the throttle valve 5*a*. A relay switch 30 is inserted into the line 31*b* which electrically connects the air flow meter 7*b* with the computer 8*b*. When the level of the output signal fed from the throttle position switch 6 is low, namely, when the opening degree of the throttle valve 5*a* is below the predetermined value, the relay switch 30 opens; thereby no signal is applied to the computer 8*b* from the air flow meter 7*b*.

Figure 2:
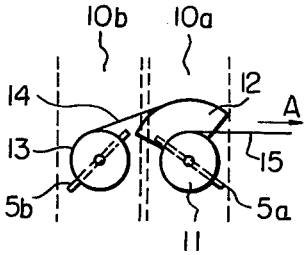
FIG. 2 is a schematic side view of the valve actuating device of the engine shown in FIG. 1.
Figure 3:
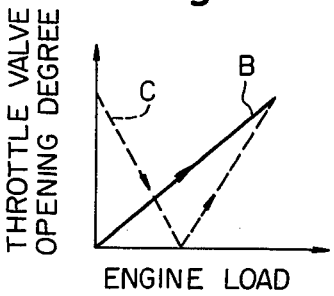
FIG. 3 is a graph showing the relationship between the engine load and the opening degree of the throttle valves.

The throttle valves 5*a* and 5*b* are co-operatively connected to each other, and they are arranged so that their rotational speeds are different from each other. FIG. 2 illustrates one embodiment of this throttle valve actuating mechanism. In FIG. 2, pulleys 11 and 12 are coaxially fixed to the throttle valve 5*a* in the first intake passage 16*a* (shown in FIG. 1), and these pulleys 11 and 12 are rotated with the throttle valve 5*a* when an accelerator wire 15 connected to an accelerator pedal (not shown) is pulled in a direction of arrow A. A pulley 13 is coaxially fixed to the throttle valve 5*b* in the second intake passage 16*b* (shown in FIG. 1). This pulley 13 is engaged with the pulley 12 through a wire 14. The ratio of the radius of the pulley 12 to the radius of the pulley 13 is adjusted to 2:1. A return spring (not shown) and a stopper (not shown) are mounted on each of the throttle valves 5*a* and 5*b* so that when an extent of the depression of the accelerator pedal is zero, the throttle valve 5*a* is in the fully closed state, namely, at the idling position, and the throttle valve 5*b* is in the fully opened state. As the extent of the depression of the accelerator pedal is increased, in other words, as the level of a load of the engine is increased, the throttle valve 5*b* is gradually turned in a closing direction while the throttle valve 5*a* is gradually turned in an opening direction. When the depression of the accelerator pedal is about ½ of the maximum depression extent, the throttle valve 5*b* is in the fully closed state; when the depression is further increased, both the throttle valves 5*a* and 5*b* are gradually opened; and when the depression of the accelerator pedal reaches maximum, both the throttle valves 5*a* and 5*b* are fully opened. This relation of the extent of depression of the accelerator pedal (the load of the engine) to the opening degree of the throttle valves 5*a* and 5*b* is illustrated in FIG. 3, in which the abscissa indicates the engine load, the ordinate indicates the degree of opening in the throttle valve, the solid line B shows the characteristic of the throttle valve 5*a* and the broken line C shows the characteristic of the throttle valve 5*b*.

Figure 4:
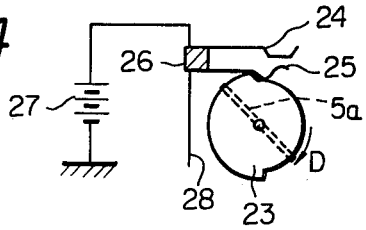
FIG. 4 is a schematic view of the load detecting device of the engine shown in FIG. 1.

FIG. 4 is a schematic view illustrating the structure of the throttle position switch 6 in the above-mentioned embodiment of FIG. 1. Referring to FIG. 4, reference numeral 23 designates a cam coaxially fixed to the throttle valve 5*a*, 24, 25 contacts, and 26 an insulator inserted between the contacts 24 and 25. When the throttle valve 5*a* is turned in a direction of arrow D, the contact 25 is pushed up by the cam 23 and the contact 24 falls in contact with the contact 25 to attain a conducting state. Accordingly, a voltage from a battery 27 is applied to the relay switch 30 (shown in FIG. 1) via a line 28. By appropriately selecting the shape of the cam 23 and the attachment angle of the cam 23 to the throttle valve 5*a*, the conducting state between the contacts 24 and 25 can be attained between an optional range of the opening degree of the throttle valve 5*a*. In the present embodiment, the shape of the cam 23 and the attachment angle of the cam 23 to the throttle valve 5*a* are arranged so that the conducting state is kept within the range from the point where the throttle valve 5*a* is half-opened to the point where the throttle valve 5*a* is fully opened.

The operation of the apparatus of the embodiment shown in FIG. 1 will now be described. When no depression of the accelerator pedal is effected, the throttle valve 5*a* in the first intake passage 16*a* is fully closed and stays at the idling position, as pointed out hereinbefore. In this case, a fuel for the idling operation is fed to the cylinders of the first group in a quantity corresponding to the signal from the air flow meter 7*a*, but since the output signal fed from the throttle position switch 6 is low and the signal from the air flow meter 7*b* is thus cut off by the relay switch 30, the fuel is not fed to the cylinders of the second group. As the extent of depression of the accelerator pedal is increased, in other words, the level of a load of the engine is increased, the amount of intake air passing through the intake passage 16*a* is increased, and thereby the level of the output signal voltage of the air flow meter 7*a* is elevated according to the degree of opening in the throttle valve 5*a*. As a result, fuel is fed to the cylinders of the first group in a quantity corresponding to the level of the signal voltage fed from the air flow meter 7*a*. In the second cylinder group, the throttle valve 5*b* is gradually closed, and since the throttle position switch 6 is still in the non-conducting state, fuel is not fed to the cylinders.

When the extent of the depression of the accelerator pedal is increased to about ½ of the maximum depression extent, the level of the output signal of the throttle position switch 6 changed to a high level so as to initiate feeding of the fuel to the cylinders of the second group. At this point when the extent of the depression of the accelerator pedal is about ½ of the maximum depression extent, the throttle valve 5*b* is fully closed. When the extent of the depression of the accelerator pedal is further increased, the opening degree is increased in each of the throttle valves 5*a* and 5*b* in the first and second intake passages 16*a* and 16*b*, and the fuel is fed to the cylinder groups in quantities corresponding to the amount of intake air passing through the intake passages 16*a* and 16*b*, respectively.

Figure 5:
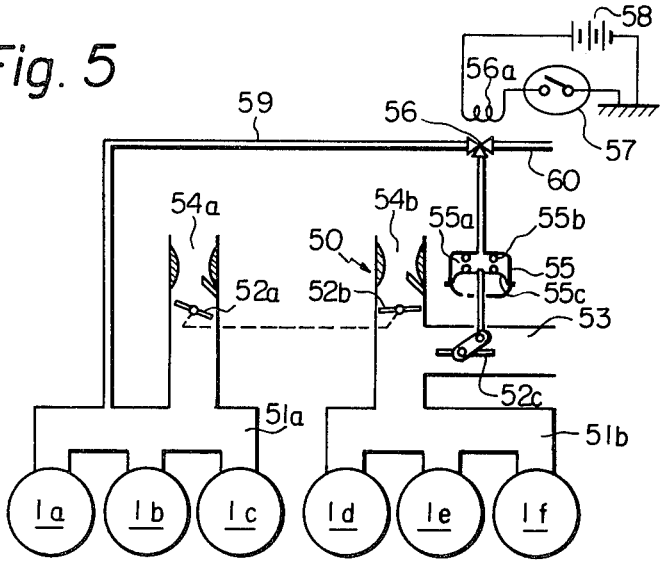
FIG. 5 is a schematic view of another embodiment of an engine according to the present invention.

FIG. 5 is a schematic view illustrating the structure of another embodiment of the present invention. In this embodiment, the present invention is employed in a carburetor type internal combustion engine having six cylinders. In FIG. 5, reference numerals 1*a*, 1*b*, 1*c*, 1*d*, 1*e*, 1*f* represent the same cylinders as those in FIG. 1.

The cylinders 1a, 1b, 1c constitute a first cylinder group and the cylinders 1d, 1e, 1f constitute a second cylinder group. Reference numerals 51a and 51b represent intake manifolds, 54a and 54b first and second intake passages, and 52a and 52b throttle valves arranged in the intake passages 54a and 54b, respectively. Reference numeral 53 represents a bypass passage for communicating the atmosphere with the second intake passage 54b at a position downstream of the throttle valve 52b, and 52c an air control valve arranged in the bypass passage 53 so as to adjust the amount of intake air passing through the bypass passage 53. This air control valve 52c is opened or closed by the operation of a diaphragm type actuator 55. More specifically, this actuator 55 is arranged so that when the sucking force applied to a diaphragm 55c caused by the vacuum pressure in a vacuum chamber 55a is greater than the pressing force applied to the diaphragm 55c by a spring 55b, the air control valve 52c is fully opened and when the sucking force of the above-mentioned vacuum pressure is smaller than the pressing force of the spring 55b, the air control valve 52c is fully closed. The vacuum chamber 55a of the actuator 55 can be communicated with the intake manifold 51a of the first intake passage 54a via a vacuum pressure conduit 59 and further with the atmosphere through a conduit 60. A three-port type electromagnetic valve 56 is disposed in the midway of the vacuum pressure conduit 59 by connecting the two ports thereof with the conduit 59, and the remaining port of the electromagnetic valve 56 is opened to the atmosphere via the conduit 60. A battery 58 and an engine temperature sensor 57 are connected in series to an exciting coil 56a of the electromagnetic valve 56. When the engine is warmed and the temperature of the engine is sufficiently high, this engine temperature sensor 57 is closed so as to energize the electromagnetic valve 56, and the vacuum chamber 55a of the actuator 55 is communicated with the intake manifold 51a of the first intake passage 54a. On the other hand, when the temperature of the engine is low, the engine temperature sensor 57 is opened, and the vacuum chamber 55a is opened to the atmosphere via the conduit 60.

Figure 6:
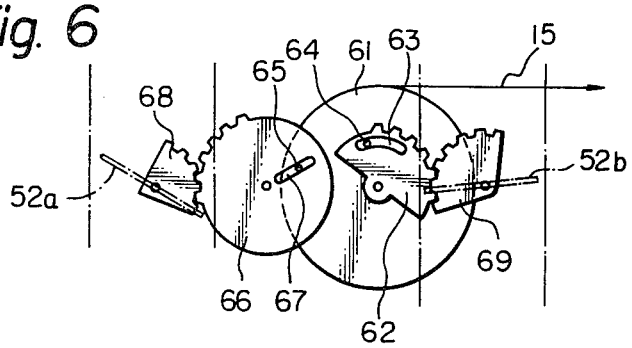
FIG. 6 is a side view of the valve actuating device of the engine shown in FIG. 5; and, FIG. 7 is a graph showing the relationship between the engine load and the opening degree of the throttle valves.

FIG. 6 is a side view illustrating a mechanism for co-operatively actuating the throttle valves 52a and 52b. Referring to FIG. 6, a pulley 61 is rotated by the accelerator wire 15 connected to the accelerator pedal. An intermediate gear 62 is connected coaxially and rotatably with the pulley 61. An arcuate slit 63 is formed on the side face of the gear 62 along the circumferential direction, and a projecting pin 64 fixed to the side portion of the pulley 61 is slidably fitted in this slit 63. Reference numeral 66 represents another intermediate gear. A slit 67 extending in the radial direction of the gear 66 is formed on the side face of the gear 66. A projecting pin 65 fixed to the side portion of the pulley 61 is slidably fitted in this slit 67. The intermediate gear 66 is engaged with a gear 68 fixed coaxially to the throttle valve 52a in the first intake passage 54a. The intermediate gear 62 is engaged with a gear 69 fixed coaxially to the throttle valve 52b in the second intake passage 54b. A return spring (not shown) and a stopper (not shown) are mounted on each of the throttle valves 52a and 52b.

When no depression of the accelerator pedal is effected, the throttle valve 52a is substantially fully closed, and the slit 65 is located horizontally in FIG. 6, and furthermore, the pin 64 is located on the right end of the arcuate slit 63 in FIG. 6. Accordingly, also the throttle valve 52b is substantially fully closed. As the extent of the depression of the accelerator pedal is increased, the throttle valve 52a is abruptly opened at first and the rotational speed is gradually lowered. The rotational speed of the throttle valve 52a in this initial stage can optionally be controlled by adjusting the distance between the centers of the pulley 61 and gear 66, and also adjusting the position of the pin 65. When the extent of the depression of the accelerator pedal exceeds a predetermined level, the pin 64 reaches to the left end of the arcuate slit 63, and the gear 62 is allowed to rotate together with the pulley 61. Accordingly, the throttle valve 52b which was kept fully closed during the first half of the rotation of the pulley 61 begins to open in direct proportion to the extent of the depression of the accelerator pedal. When the extent of the depression of the accelerator pedal reaches maximum, both the throttle valves 52a and 52b are fully opened. Incidentally, the rotation angle of the gear 66 is considerably smaller than 90°, but if the radius ratio of the gear 66 to the gear 68 is appropriately set, a sufficient degree of opening can be provided for the throttle valve 52a.

Figure 7:
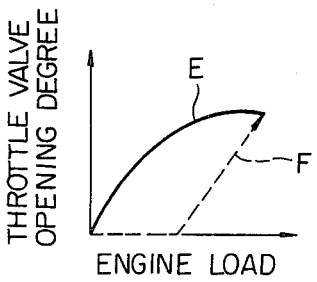

FIG. 7 is a graph illustrating the above-mentioned characteristics of the opening degrees of the throttle valves 52a and 52b. In FIG. 7, the abscissa indicates the engine load, the ordinate indicates the degree of opening in the throttle valve, the solid line E shows the characteristic of the throttle valve 52a, and the broken line F shows the characteristic of the throttle valve 52b.

The operation of the latter embodiment will now be described. When no depression of the accelerator pedal is effected, the throttle valve 52a is substantially fully closed, namely stays at the idling position, as pointed out hereinbefore, and a fuel for idling operation is fed to the cylinders of the first group as in conventional carburetor engines. Also, the throttle valve 52b for the cylinders of the second group is substantially fully closed. However, since the level of the vacuum pressure in the intake manifold 51a in the first intake passage 54a is high, the air control valve 52c is fully opened. In this case, since air is not allowed to flow through a carburetor 50 which is arranged in the second intake passage 54b upstream of the throttle valve 52b, fuel is not fed to the cylinders of the second group. In other words, in the cylinders of the second group, the air intake passage is fully opened but the fuel is not fed. As the extent of the depression of the accelerator pedal is increased, in the initial state, the throttle valve 52a is abruptly opened so as to increase the load of the cylinders of the first group; but in the cylinders of the second group, the throttle valve 52b is still substantially fully closed and air control valve 52c is fully opened. When the extent of the depression of the accelerator pedal is further increased so as to considerably increase the opening degree of the throttle valve 52a, the level of the vacuum pressure in the intake manifold 51a of the first intake passage 54a becomes closer to the atmospheric pressure level beyond the predetermined value, for example, −150 mHg. As a result, the air control valve 52c of the bypass passage 53 fully closes, and thereby air begins to flow from a slight clearance of the throttle valve 52b. Then, the carburetor 50 in the second intake passage 54b initiates feeding of fuel. Accordingly, the cylinders of the second group will start the firing operation.

When the extent of the depression of the accelerator pedal is further increased, the throttle valve 52b is accordingly opened and the air control valve 52c is kept fully closed. Therefore, the cylinders of the second group are also operated in accordance with the amount of intake air.

The foregoing operation is conducted when the engine is sufficiently warmed and the engine temperature sensor 57 is closed. As the start of the engine, since the temperature of the engine, for example, the temperature of the cooling water, is low, the engine temperature sensor 57 is opened as pointed out hereinbefore, and the atmospheric pressure is applied to the vacuum chamber 55*a* of the actuator 55 by the action of the electromagnetic valve 56. Accordingly, the air control valve 52*c* is always kept fully closed. Therefore, the fuel is also fed to the cylinders of the second group through the carburetor 50 from the beginning, and hence, the operation stability of the engine in the cold state is improved. When the temperature of the engine is elevated beyond a predetermined level, the engine temperature sensor 57 is closed and the above-mentioned normal operation is conducted.

In the embodiment having the structure shown in FIG. 5, although only the cylinders of the first group are operated while the extent of the depression of the accelerator pedal (namely, the level of the engine load) is small, but in this case, since the opening degree of the throttle valve 52*a* is abruptly increased in the initial stage, the operation characteristic of the engine can be remarkably improved.

In the embodiment shown in FIG. 5, carburetors are employed. However, in an engine having the bypass intake air passage, an air flow meter, a computer and fuel injection valves are appropriately employed instead of the carburetor. Namely, the fuel injection type engine can also be adopted in the embodiment shown in FIG. 5.

In each of the foregoing embodiments, six cylinders are divided into two groups. As will be apparent to those skilled in the art, the present invention can similarly be applied to embodiments in which a number of cylinders are divided into three or more groups. In these embodiments, from the viewpoint of preventing engine vibrations, from occurring, it is preferred that the cylinders of the respective groups be alternately ignited. In the case of V type engine, or flat and opposed type engine, from the viewpoint of facility in designing, it is preferred that all cylinders be divided into groups of each rows.

As will readily be understood from the foregoing illustration, in the internal combustion engine according to the present invention, when the required load of the engine is small, only some of the cylinders are ignited and operated and the amount of intake air is increased for the remaining de-energized cylinders by keeping the throttle valve or the air control valve fully open. Accordingly, the load on the energized cylinders is increased but the pumping loss in the de-energized cylinders is reduced. Therefore, in the present invention, the specific fuel consumption can be maintained at a level much lower than in conventional engines where a uniform load is imposed on all of the cylinders. Furthermore, when the required load is large, since all the cylinders are operated, the maximum power of the engine can be readily obtained. Moreover, in the present invention, these excellent effects can be attained by using a very simple structure.

As many widely different embodiments of the present invention may be constructed without departing from the spirit and scope of the present invention, it should be understood that the present invention is not limited to the specific embodiments described in this specification, except as defined in the appended claims.

What is claimed is:

1. An internal combustion engine having a plurality of cylinders which are divided into a first cylinder group and a second cylinder group, said first cylinder group having a first intake passage, said second cylinder group having a second intake passage, said engine comprising:

a first air control means arranged in said first intake passage for controlling an amount of intake air fed into said first cylinder group;

a first fuel supplying means for supplying said first cylinder group with an amount of fuel in accordance with the amount of intake air passing through said first intake passage;

a second air control means for controlling an amount of intake air fed into said second cylinder group, said second air control means allowing an inflow of air into said second cylinder group when the level of a load of said engine is lower than a predetermined level;

a second fuel supply means for supplying said second cylinder group with an amount of fuel in accordance with the amount of intake air passing through said second intake passage, said fuel supply operation being carried out, when the level of the load of said engine is higher than said predetermined level, said second fuel supply means stopping said fuel supplying operation into said second cylinder group when the level of the load of said engine is lower than said predetermined level, and;

an actuating means for increasing an amount of intake air passing through said first air control means in accordance with an increase in the level of the load of said engine, and for increasing an amount of intake air passing through said second air control means in accordance with an increase in the level of the load of said engine when the level of the load of said engine exceeds said predetermined level, said increasing speed of the amount of intake air passing through said second air control means being controlled higher than said increasing speed of the amount of intake air passing through said first air control means.

2. An internal combustion engine as claimed in claim 1, wherein said first air control means comprises a first throttle valve, and said second air control means comprises a second throttle valve arranged in said second intake passage.

3. An internal combustion engine as claimed in claim 2, wherein said actuating means includes a valve actuating means includes a valve actuating means connected to said first throttle valve for increasing the opening degree of said first throttle valve in accordance with an increase in the level of the load of said engine, and connected to said second throttle valve for increasing the opening degree of said second throttle valve in accordance with an increase in the level of the load of said engine when the level of the load of said engine is higher than said predetermined level, said valve actuating means being also connected to said second throttle valve for decreasing the opening degree of said second valve in accordance with an increase in the level of the load of said engine when the level of the load of said engine is lower than said predetermined level.

4. An internal combustion engine as claimed in claim 3, wherein said valve actuating means comprises:

a first rotary member connected to said first throttle valve and rotated in accordance with an increase in the level of the load of said engine, and;

a second rotary member connected to said second throttle valve and rotated faster than said first rotary member in accordance with an increase in the level of the load of said engine.

5. An internal combustion engine as claimed in claim 4, wherein said valve actuating means further comprises a third rotary member connected to said first throttle valve and rotated in accordance with an increase in the level of the load of said engine, said third rotary member having a radius larger than a radius of said first rotary member and being engaged with said second rotary member for causing said second rotary member to rotate faster than said first rotary member in accordance with an increase in the level of the load of said engine.

6. An internal combustion engine as claimed in claim 2, wherein said engine further comprises a load detecting means for detecting that the opening degree of said first throttle valve exceeds a predetermined value, and for generating a signal which indicates that the level of the load of said engine is higher than said predetermined level.

7. An internal combustion engine as claimed in claim 2, wherein each of said first fuel supply means and said second fuel supply means comprises:

an air flow meter arranged in said first intake passage upstream of said first throttle valve or said second intake passage upstream of said second throttle valve for detecting an amount of intake air passing therethrough;

an electrical computer for calculating an optimum amount of fuel fed into said first cylinder group or said second cylinder group in accordance with said detected amount of intake air, and;

at least one fuel injection valve arranged in said first intake passage downstream of said first throttle valve or said second intake passage downstream of said second throttle valve for supplying said first cylinder group or said second cylinder group with the amount of fuel corresponding to said calculated amount.

8. An internal combustion engine as claimed in claim 1, wherein said engine further comprises a bypass passage communicating the atmosphere with said second intake passage.

9. An internal combustion engine as claimed in claim 8, wherein said first air control means comprises a first throttle valve, and said second air control means comprises a second throttle valve arranged in said second intake passage and a valve means arranged in said bypass passage for allowing an inflow of air into said second cylinder group when the level of the load of said engine is lower than said predetermined level.

10. An internal combustion engine as claimed in claim 9, wherein said bypass passage communicates the atmosphere with said second intake passage at a position downstream of said second throttle valve, wherein said actuating means comprises:

a valve actuating means connected to said first throttle valve for increasing the opening degree of said first throttle valve in accordance with an increase in the level of the load of said engine, and connected to said second throttle valve for increasing the opening degree of said second throttle valve in accordance with an increase in the level of the load of said engine when the level of the load of said engine is higher than said predetermined level, said valve actuating means causing said second throttle valve to close when the level of the load of said engine is lower than said predetermined level, and;

a vacuum operated control means for opening said valve means in said bypass passage when the level of the vacuum produced in said first intake passage is reduced below a predetermined level, and for closing said valve means when the level of the vacuum produced in said first intake passage exceeds said predetermined level.

11. An internal combustion engine as claimed in claim 10, wherein said valve actuating means comprises:

a first rotary members rotated in accordance with an increase in the level of the load of said engine;

a second rotary member connected to and rotated with said first throttle valve, and;

a link means interconnecting said first rotary member with said second rotary member for rapidly opening said first throttle valve during the first half of the rotation of said first rotary member and for causing said first throttle valve to remain fully open during the latter half of the rotation of said first rotary member.

12. An internal combustion engine as claimed in claim 11, wherein said second rotary member comprises a first gear; and said link means comprises a second gear engaged with said first gear and having a slit, and a pin mounted on said first rotary member and fitted into said slit of said second gear.

13. An internal combustion engine as claimed in claim 10, wherein said valve actuating means comprises:

a first rotary member rotated in accordance with an increase in the level of the load of said engine;

a second rotary member connected to and rotated with said second throttle valve, and;

a link means intermittently connecting said first rotary member with said second rotary member for causing said second throttle valve to remain close during the first half of the rotation of said first rotary member and for increasing the opening degree of said second throttle valve during the latter half of the rotation of said first rotary member.

14. An internal combustion engine as claimed in claim 13, wherein said second rotary member comprises a first gear, wherein said link means comprises: a second gear engaged with said first gear and having an arcuate slit, said second gear being coaxially positioned with said first rotary member, and; a pin mounted on said first rotary member and fitted into said arcuate slit of said second gear.

15. An internal combustion engine as claimed in claim 10, wherein said vacuum operated control means comprises a diaphragm apparatus having a vacuum chamber which is defined by a diaphragm, said vacuum chamber being connected to said first intake passage, said diaphragm being connected to said valve means.

16. An internal combustion engine as claimed in claim 15, wherein said vacuum operated control means further comprises a control valve for opening said vacuum chamber of said diaphragm apparatus to the atmosphere causing said valve means to close when the temperature value of said engine is lower than a predetermined value.

* * * * *

UNITED STATES PATENT AND TRADEMARK OFFICE

CERTIFICATE OF CORRECTION

PATENT NO. : 4,204,514

DATED : May 27, 1980

INVENTOR(S) : Yasuhiko Ishida

It is certified that error appears in the above—identified patent and that said Letters Patent is hereby corrected as shown below:

Col. 7, line 5, change "As" to --At--.

Col. 8, line 53, After first occurrence of "means" delete --includes a valve actuating means--.

Col. 10, line 16, change "members" to --member--.

Col. 10, line 41, change "close" to --closed--.

Signed and Sealed this

*Fourteenth* Day of *October 1980*

[SEAL]

*Attest:*

SIDNEY A. DIAMOND

*Attesting Officer*

*Commissioner of Patents and Trademarks*